US009113682B2

(12) United States Patent
Kingsbury et al.

(10) Patent No.: US 9,113,682 B2
(45) Date of Patent: Aug. 25, 2015

(54) MODULAR DECORATIVE LOCKET

(71) Applicants: Christina H. Kingsbury, Hendersonville, TN (US); Nola F. Heatherly, Ooltewan, TN (US)

(72) Inventors: Christina H. Kingsbury, Hendersonville, TN (US); Nola F. Heatherly, Ooltewan, TN (US)

( * ) Notice: Subject to any disclaimer, the term of this patent is extended or adjusted under 35 U.S.C. 154(b) by 90 days.

(21) Appl. No.: 13/831,658

(22) Filed: Mar. 15, 2013

(65) Prior Publication Data

US 2013/0239612 A1 Sep. 19, 2013

Related U.S. Application Data

(60) Provisional application No. 61/685,391, filed on Mar. 16, 2012.

(51) Int. Cl.
*A44C 25/00* (2006.01)

(52) U.S. Cl.
CPC ..... *A44C 25/002* (2013.01)

(58) Field of Classification Search
CPC ..... A44C 25/002; A44C 25/00
USPC ..... 63/18, 1.14
See application file for complete search history.

(56) References Cited

U.S. PATENT DOCUMENTS

| | | | | |
|---|---|---|---|---|
| 316,118 | A * | 4/1885 | Cooke | 63/18 |
| 367,087 | A * | 7/1887 | Briggs | 63/18 |
| 780,292 | A * | 1/1905 | Jones | 222/565 |
| 4,444,324 | A * | 4/1984 | Grenell | 215/6 |
| 4,866,952 | A * | 9/1989 | Hight et al. | 63/18 |
| 5,669,400 | A * | 9/1997 | Sheffler et al. | 132/295 |
| 5,755,116 | A * | 5/1998 | Sparacino et al. | 63/3 |
| 6,244,073 | B1 * | 6/2001 | Kaping, Jr. | 63/12 |
| 6,470,709 | B1 * | 10/2002 | Siekierski | 63/12 |
| D515,429 | S * | 2/2006 | Pace | D9/529 |
| 2005/0241335 | A1 * | 11/2005 | Scharr | 63/3.1 |
| 2009/0241596 | A1 * | 10/2009 | Fulkerson | 63/3.1 |
| 2013/0239612 | A1 * | 9/2013 | Kingsbury et al. | 63/18 |
| 2013/0327774 | A1 * | 12/2013 | Farias, Jr. | 220/288 |

FOREIGN PATENT DOCUMENTS

| | | | | |
|---|---|---|---|---|
| GB | 190900832 | * | 0/1909 | A44C 25/002 |

OTHER PUBLICATIONS www.instructables.com/id/Plastic-Soda-Bottle-Lid-Capsule/ published Nov. 18, 2011. /member/bfgreen/.* www.instructables.com/id/Micro-Geocache-Container/ published May 2, 2010. /member/BrantFlakes315/.*

Capture of "Micro Geocache Container" on Sep. 16, 2010 by wayback machine.*

Capture of "Plastic Soda Bottle Lid Capsule" on Nov. 21, 2011, by wayback machine.*

* cited by examiner

*Primary Examiner* — Emily Morgan
(74) *Attorney, Agent, or Firm* — Faegre Baker Daniels LLP

(57) ABSTRACT

A locket is provided including a cap and a base. The cap includes a cylindrical wall portion; a top portion combining with the cylindrical portion to define an internal cap aperture, the internal aperture having internal threads defined therein; and a decorative element protruding from the top portion in a direction opposite of the cylindrical wall portion. The base includes a bottom and a cylindrical wall, the cylindrical wall defining an internal base aperture. The base further including outwardly protruding threads operable to selectively engage threads of the cap such that rotational motion of the cap or base causes engagement and disengagement of the cap and the base. The base further including a track including upper and lower annular elements, the track sized and shaped to receive at least a portion of a coupler therein.

16 Claims, 5 Drawing Sheets

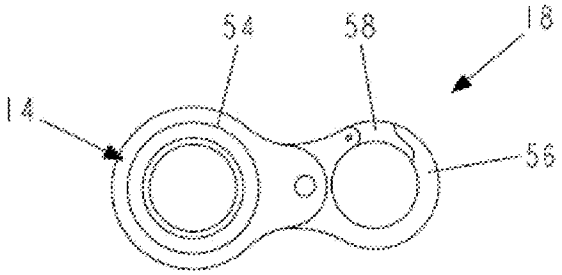
FIG. 6
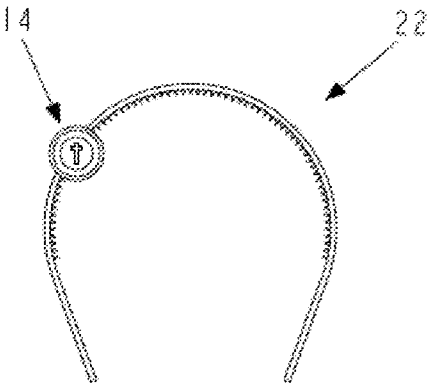
FIG. 8
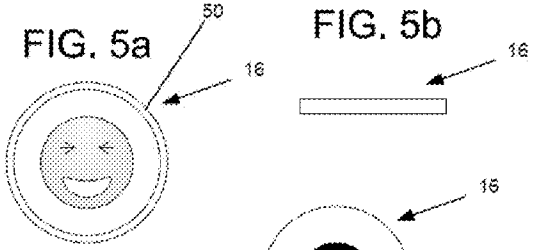
FIG. 5a
FIG. 5b
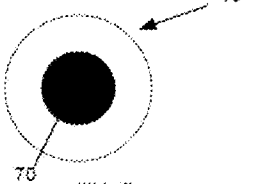
FIG. 5c
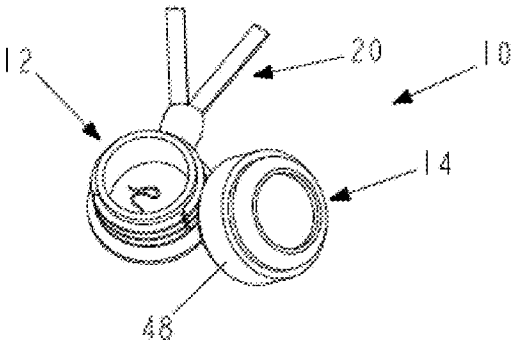
FIG. 7

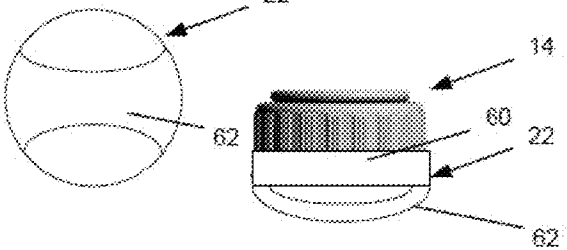
FIG. 10a
FIG. 10b
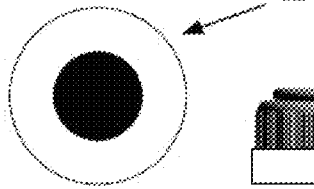
FIG. 9a
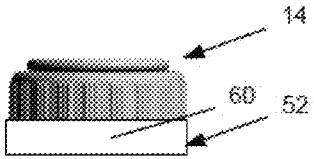
FIG. 9b
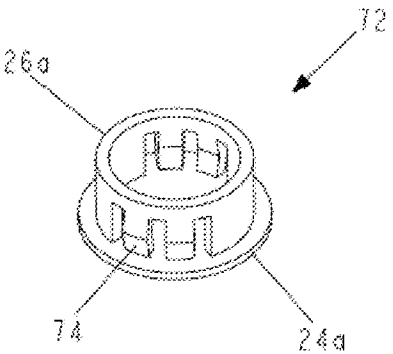
FIG. 11

MODULAR DECORATIVE LOCKET

PRIORITY

The present application is a non-provisional application that claims priority to U.S. Provisional Patent Application No. 61/685,391, titled POP LOCKET, filed Mar. 16, 2012, the disclosure of which is explicitly incorporated herein.

FIELD

The present disclosure relates to fashion accessories. More particularly, the present disclosure relates to locket-style fashion accessories.

BACKGROUND AND SUMMARY

Fashion accessories allow for personalizing a user's "look." Lockets have been used to hold items such as pictures in a wearable container.

According to a first embodiment of the present disclosure, a locket is provided including a cap and a base. The cap includes a cylindrical wall portion; a top portion combining with the cylindrical portion to define an internal cap aperture, the internal aperture having internal threads defined therein; and a decorative element protruding from the top portion in a direction opposite of the cylindrical wall portion. The base includes a bottom and a cylindrical wall, the cylindrical wall defining an internal base aperture. The base further including outwardly protruding threads operable to selectively engage threads of the cap such that rotational motion of the cap or base causes engagement and disengagement of the cap and the base. The base further including a track including upper and lower annular elements, the track sized and shaped to receive at least a portion of a coupler therein.

According to another embodiment of the present disclosure, a sleeve is provided including a body having a cylindrical wall defining an upwardly open aperture sized and shaped to receive and secure a cap therein that is sized and shaped to be received on an industry standard two-liter bottle, the body including a bottom coupled to the cylindrical wall; and a coupler attached to the bottom of the body.

According to another embodiment of the present disclosure, a plastic cap including; a cylindrical wall portion; a top portion combining with the cylindrical portion to define an internal cap aperture, the internal aperture having internal threads defined therein, the threads sized and shaped to be compatible with industry standard threads on a 20 oz/1-liter/2-liter bottle ; and a decorative element protruding from the top portion in a direction opposite of the cylindrical wall portion.

BRIEF DESCRIPTION OF THE DRAWINGS

The above-mentioned and other features of the disclosure, and the manner of attaining them, will become more apparent and will be better understood by reference to the following description of embodiments of the disclosure taken in conjunction with the accompanying drawings, wherein:

FIGS. 5*a-c* are overhead, side, and underneath plan views of an insert for use with the closure base of FIGS. 1*a-c;*

FIGS. 6-8 show portions of the closures of the preceding figures in various fashion uses;

FIGS. 9*a-b* show underneath and side plan views of a first embodiment coupler;

FIGS. 10*a-b* show underneath and side plan views of a second embodiment coupler; and FIG. 11 is a prespective view of a hole plug used in embodiments of the closure base.

DETAILED DESCRIPTION

Figure 1B:
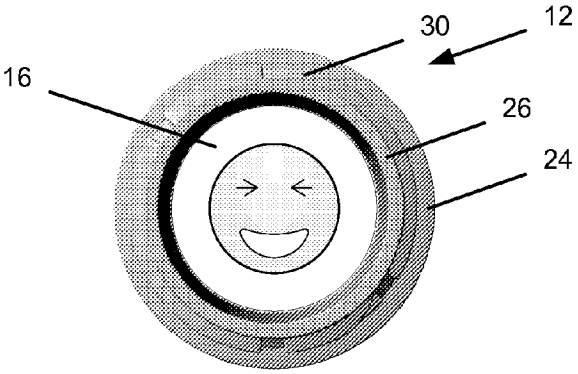
FIGS. 1*a-c* are perspective and plan views of an exemplary first embodiment closure base.

Closure 10 of the present disclosure (FIG. 7) includes base 12, cap 14, optionally insert 16, optionally hole plug 72, and optionally a coupler 18, 20, and optionally silicone sleeve 22, 52. Cap 14 couples to base 10 to form an enclosure. Coupler 18, 20, 22 attaches to base 12 and/or cap 14 to permit closure 10 to be coupled to a person, clothing, or other item.

Figure 1A:
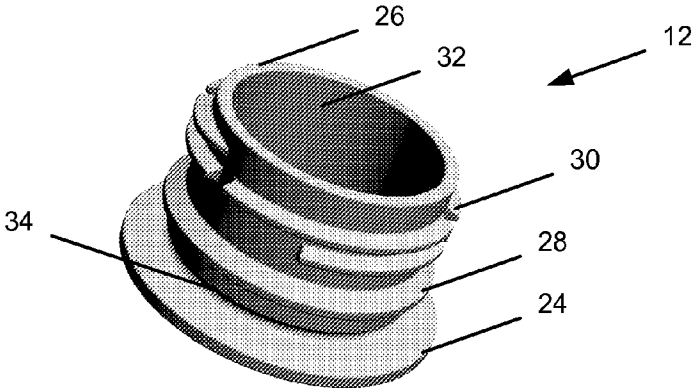
Figure 1C:
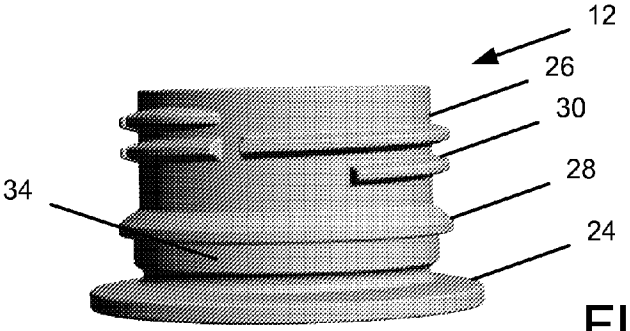
Figure 2B:
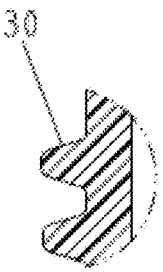
FIGS. 2*a-b* are cross sectional views of the exemplary first embodiment closure base of FIGS. 1*a-c;*
Figure 3B:
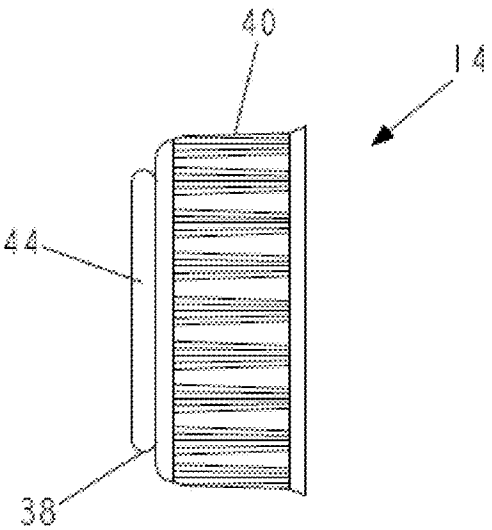
FIGS. 3*a-b* are cross sectional and plan views of an exemplary first embodiment closure cap.
Figure 2A:
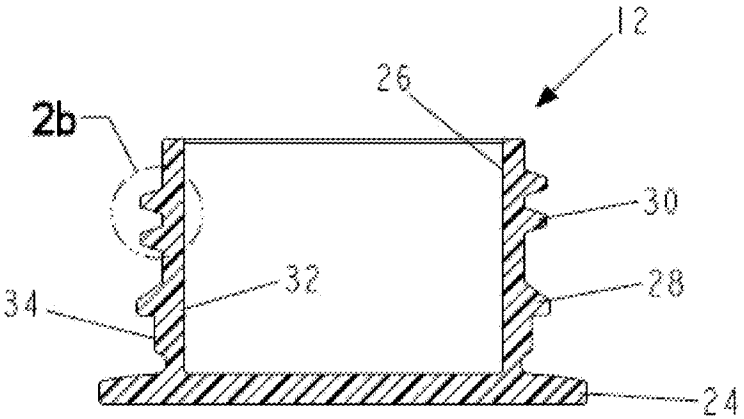
Figure 3A:
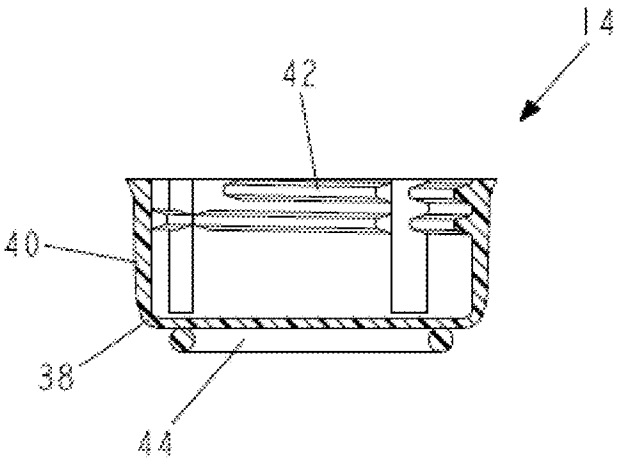
Figure 4A:
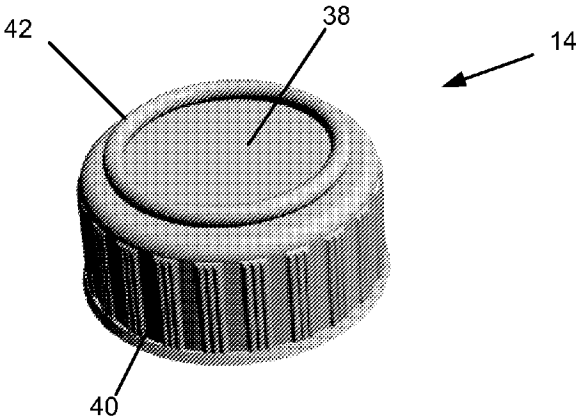
FIGS. 4*a-d* are perspective and plan views of the exemplary first embodiment closure cap of FIGS. 3*a-b;*
Figure 4B:
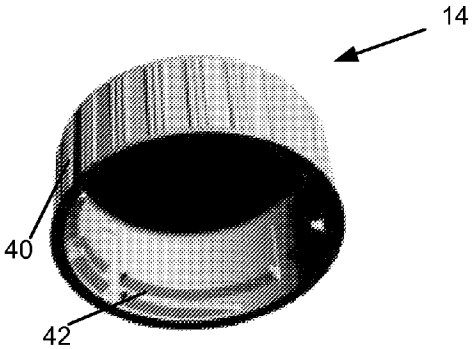
Figure 4C:
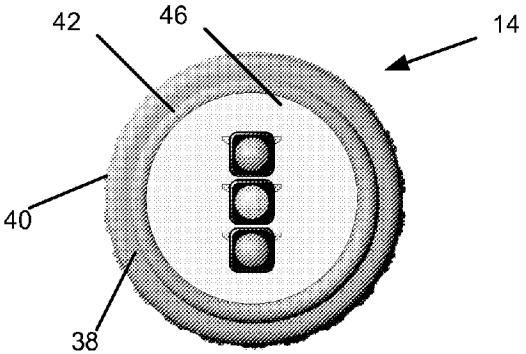
Figure 4D:
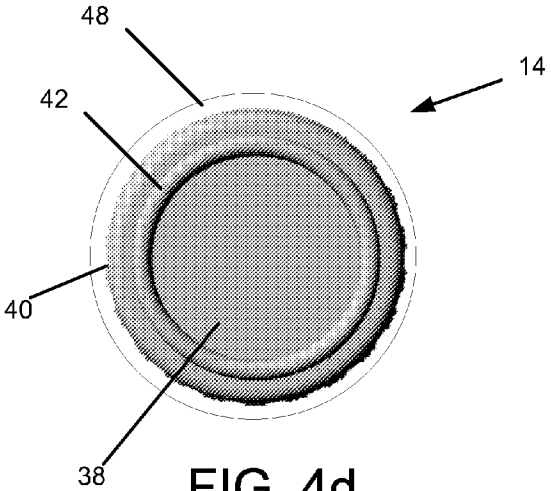

FIGS. 1*a-c* illustrate a first embodiment base 12. Base 12 is formed from molded plastic and includes bottom 24 and cylindrical wall 26. Cylindrical wall 26 includes retaining ring 28, threads 30, and central aperture 32. Bottom 24 is circular and has a diameter greater than that of cylindrical wall 26. Retaining ring 28 extends radially outward from cylindrical wall 26 and forms track 34 between ring 28 and bottom 24. Track 34 is sized and located to allow couplers 18, 20, 22 to be received thereby while allowing selective attachment and detachment of cap 14 to and from base 12. Threads 30 are sized and arranged to comply with industry-standard bottle cap thread sizes for plastic two-liter, one-liter, and 20 oz bottles. Central aperture 32 is sized to receive insert 16. The diameter of central aperture 32 is slightly larger than the outer diameter of insert 16. Alternatively, as discussed below, in certain embodiments, insert 16 is sized to abut the walls of central aperture 32. In one embodiment, central aperture 32 is approximately one half inches deep, which corresponds to cylindrical wall 26 being approximately one half inches high.

In one embodiment, base 12 is formed by cutting off the top of a two-liter, one-liter, or 20 oz bottle. In such an embodiment, hole plug 72 (FIG. 11) is used to provide bottom 24. Hole plug 72 is a plastic piece that includes bottom 24*a* and cylindrical side wall 26*a*. Side wall 26*a* includes two sets of opposing pawls 74. Pawls 74 are cantilevered downward and flex relative to the rest of wall 26*a*. The middle of pawls 74 extend outward relative to cylindrical side wall 26*a*. Lower ends of pawls 74 extend inward relative to cylindrical side wall 26*a*. Side wall 26*a* is sized to fit within the neck of a cut off two liter bottle. Hole plug 72 is inserted into the cut off bottle from below and is frictionally fit therein via the outwardly extending middles of pawls 74. When insert 16 is placed within hole plug 72, pawls 74 flex outward to allow insert 16 to pass by their lower ends. Once insert 16 passes the lower ends of pawls 74, the lower ends flex back inward to retain insert 16 between the lower ends of pawls 71 and bottom 24*a*. Hole plug 72 optionally includes a logo glued, engraved, or otherwise adhered to base 26*a*, in such embodiments the logo is covered when insert 16 is inserted.

Cap 14 includes top wall 38, side wall 40, threads 42, top ring 44, design element 46, and optionally gripping ring 48. Top wall 38 is integrally formed with side wall 40 and is formed from molded plastic. Top wall 38 extends generally perpendicularly to side wall 40. Side wall 40 is cylindrical and includes inwardly exending threads 42. Threads 42 are sized and arranged to comply with industry-standard bottle cap thread sizes for plastic two-liter, one-liter, and 20 oz bottles. Top ring 44 is coupled to the outer side of top wall 38. Top ring 44 is integrally molded with top wall 38 in one embodiment and adhered to top wall 38 in another embodiment. Design element 46 is disposed within top ring 44 and sealed thereto via polyeurethane, an adhered clear plastic, or otherwise over top of design element 46 within top ring 44. Any suitable sealing agent can be used so long as it preserves the ability for design element 46 to be perceived by a user. Gripping ring 48 is illustratively a ring of silicone that frictionally or otherwise engages side wall 40.

In one embodiment, insert 16 is constructed from nylon and positioned within central aperture 32 of base 12. As shown in FIGS. 5*a-b* and FIG. 1*b*, insert 16 is illustratively a flat disc sized to fit within central aperture 32 and lie flat against bottom 24 therein. Insert 16 has an ornamental image displayed thereon. In one embodiment, insert 16 includes a silicone border 50 operable to engage cylindrical wall 26 of central aperture 32 to hold insert 16 therein. As shown in FIG. 5*c*, in certain embodiments, insert 16 includes magnet 70 therein.

Accordingly, cap 14 threadably engages base 12 to form an enclosure in which items can be placed. Additionally, in that threads 30 of cap 14 are compatible with the industry standard for threads of 2 liter, 1 liter, and 20 oz. bottles, caps 14 can be placed on such bottles to provide indicia of ownership or to allow unique identification thereof Additionally, various couplers 18, 20, 22, 52 are provided. Coupler 18 is a keychain type coupler. Keychain coupler 18, FIG. 6, includes a first coupling portion 54 and a second coupling portion 56. First coupling portion 54 is sized and shaped to secure around bottom 24 (or the analogous structure on a drink bottle). First coupling portion 54 includes an annular recess that receives a portion of bottom 24 therein. Keychain coupler 18 thereby provides for closure 10 or a bottle with cap 14 to be secured thereto. Second coupling portion 56 is illustratively hingedly connected to first coupling portion 54 and includes hinge clasp 58. Hinge clasp 58 selectively opens to allow attachment to clothing loops, backpack loops, or the like. Accordingly, keychain coupler 18 provides for the coupling of closure 10 and bottles to garments or items.

Coupler 20 is a necklace type coupler. Necklace coupler 20 is illustratively a knotted loop of silicone cord. The knot is placed to allow closure 10 to be secured to coupler 20 by having a portion thereof disposed within track 34. Alternatively, necklace coupler 20 includes a molded portion of silicone (or other suitable material) that is sized to fit within track 34 to hold closure 10 thereto.

Coupler 22, FIGS. 10*a-b* and FIG. 8 is a silicone receiver. Coupler 22 includes cap receiver 60 and a coupling loop 62. Cap receiver 60 is sized to slightly deform to receive cap 14 therein and then frictionally engage cylindrical wall 26 to hold cap 14 therein. Coupling loop 62 forms an attachment aperture 76 sized to receive headband 64, slap bracelet, or any other suitable item to provide for such item to be adorned with cap 14.

Coupler 52 is also a silicone receiver. Coupler 52 includes cap receiver 60 and has magnet 66 disposed in bottom surface 68 of cap receiver. Again, cap 14 is held within cap receiver 60. When so received, cap 14 is able to be attached to magnetically receptive surfaces to adorn such surfaces with cap 14.

It should be appreciated that the colors of various components can be changed and/or mixed and matched to provide differing fashion impressions.

While this invention has been described as having preferred designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this disclosure pertains and which fall within the limits of the appended claims.

What is claimed is:

1. A locket including:
a cap including;
a cylindrical wall portion;
a top portion combining with the cylindrical portion to define an internal cap aperture, the internal aperture having internal threads defined therein; and
a decorative element protruding from the top portion in a direction opposite of the cylindrical wall portion;
a base including:
a cylindrical wall having an outer surface and an inner surface, the outer surface having outwardly protruding threads operable to selectively engage threads of the cap such that rotational motion of the cap or base causes engagement and disengagement of the cap and the base, the inner surface defining an internal base aperture;
a hole plug including pawls, the hole plug being received within the base aperture and frictionally engaging the inner surface, the hole plug providing a bottom of the base; and
a track including upper and lower annular elements, the track sized and shaped to receive at least a portion of a coupler therein.

2. The locket of claim 1, further including a ring coupled to the top portion of the cap wherein the decorative element is located within the ring.

3. The locket of claim 1, further including a coupler attached to the base via the track.

4. The locket of claim 3, wherein the coupler is a necklace.

5. The locket of claim 1, wherein the size and pitch of the internal threads and the outwardly protruding threads are consistent with industry standard thread size and pitch for two-liter plastic bottles.

6. The locket of claim 1, wherein the internal base aperture is greater than 0.5 inches deep.

7. The locket of claim 1, wherein the pawls of the hole plug selectively hold an insert adjacent the bottom.

8. The locket of claim 1, further including a decorative insert sized and shaped to be received in the internal base aperture.

9. The locket of claim 1, further including a gripping ring encircling and engaged to an outer side of the cylindrical wall.

10. A locket including:
a cap including;
a cylindrical wall portion;
a top portion combining with the cylindrical portion to define an internal cap aperture, the internal aperture having internal threads defined therein; and
a base including:
a bottom wall having a diameter and two opposing planar surfaces;
a cylindrical wall having a diameter and is integral with the bottom wall, the cylindrical wall including outwardly protruding threads operable to selectively engage threads of the cap such that rotational motion of the cap or base causes engagement and disengagement of the cap and the base; the cylindrical wall together with the bottom wall defining an internal base aperture, the diameter of the bottom wall being greater than the diameter of the cylindrical wall; and a track formed by a portion of the cylindrical wall between the bottom wall and the protruding threads, the track sized and shaped to receive at least a portion of a coupler therein.

11. The locket of claim 10, further including a ring coupled to the top portion of the cap.

12. The locket of claim 10, further including a coupler attached to the base via the track.

13. The locket of claim 12, wherein the coupler is a necklace.

14. The locket of claim 10, wherein the size and pitch of the internal threads and the outwardly protruding threads are consistent with industry standard thread size and pitch for two-liter plastic bottles.

15. The locket of claim 10, further including a decorative insert sized and shaped to be received in the internal base aperture.

16. The locket of claim 10, further including a magnet.

* * * * *